US012018544B2

(12) United States Patent
Deffieux et al.

(10) Patent No.: US 12,018,544 B2
(45) Date of Patent: Jun. 25, 2024

(54) COMPLETION ISOLATION SYSTEM WITH TUBING MOVEMENT COMPENSATOR

(71) Applicant: Schlumberger Technology Corporation, Sugar Land, TX (US)

(72) Inventors: Damien Deffieux, Houston, TX (US); Alessandro Boldi, Bucharest (RO)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/003,371

(22) PCT Filed: Jun. 30, 2021

(86) PCT No.: PCT/US2021/039873
§ 371 (c)(1),
(2) Date: Dec. 27, 2022

(87) PCT Pub. No.: WO2022/006262
PCT Pub. Date: Jan. 6, 2022

(65) Prior Publication Data

US 2023/0143015 A1 May 11, 2023

Related U.S. Application Data

(60) Provisional application No. 63/047,401, filed on Jul. 2, 2020.

(51) Int. Cl.
*E21B 33/127* (2006.01)
*E21B 33/12* (2006.01)

(52) U.S. Cl.
CPC ..... *E21B 33/1277* (2013.01); *E21B 33/1208* (2013.01)

(58) Field of Classification Search
CPC .. E21B 33/1277; E21B 33/1208; E21B 17/07; E21B 33/10; E21B 33/12
See application file for complete search history.

(56) References Cited

U.S. PATENT DOCUMENTS 3,774,919 A * 11/1973 Kreuzer ..... F16J 15/32 277/589
3,863,719 A * 2/1975 Parker ..... E21B 23/006 166/305.1

(Continued)

FOREIGN PATENT DOCUMENTS

CN 106401540 A 2/2017

OTHER PUBLICATIONS

International Search Report and Written Opinion issued in the PCT Application PCT/US2021/039873, dated Oct. 5, 2021 (10 pages).

*Primary Examiner* — Steven A MacDonald
(74) *Attorney, Agent, or Firm* — Jeffrey D. Frantz

(57) ABSTRACT

A system includes a tubular disposed within a borehole, a sleeve disposed around the tubular, and an isolation element bounded to an outer diameter of the sleeve. The inner diameter of the sleeve is connected to an outer diameter of the tubular via a plurality of seals. The isolation element is configured to conform to a surface of the borehole when the isolation element is in an expanded configuration. The sleeve compensates for movement of the tubular by being able to freely move across the tubular.

21 Claims, 2 Drawing Sheets

(56) References Cited

U.S. PATENT DOCUMENTS 4,237,979 A * 12/1980 Weise ..... E21B 33/1294 166/123
4,290,484 A * 9/1981 Beall ..... E21B 17/07 285/302
4,423,777 A * 1/1984 Mullins ..... E21B 33/1295 166/212
4,726,419 A * 2/1988 Zunkel ..... E21B 23/06 166/278
6,648,335 B1 * 11/2003 Ezell ..... E21B 23/04 166/387
6,902,008 B2 * 6/2005 Hirth ..... E21B 33/128 166/212
7,172,029 B2 * 2/2007 Hirth ..... E21B 33/128 277/338
8,347,969 B2 1/2013 Orr
9,200,498 B2 * 12/2015 Klimack ..... E21B 33/10
2003/0132008 A1 * 7/2003 Hirth ..... E21B 33/128 166/134
2005/0155775 A1 * 7/2005 Hirth ..... E21B 33/128 166/387
2008/0289813 A1 * 11/2008 Gewily ..... E21B 34/12 166/179
2010/0096119 A1 * 4/2010 Sevre ..... E21B 33/1294 166/51
2014/0190683 A1 7/2014 Hallunbæk
2014/0190708 A1 * 7/2014 Hallundbaek ..... E21B 33/1277 166/207
2015/0041129 A1 * 2/2015 Mani ..... E21B 43/24 166/57
2015/0184489 A1 * 7/2015 Resweber ..... E21B 34/14 166/183
2015/0211335 A1 * 7/2015 Boyle ..... E21B 43/24 166/57
2016/0032693 A1 2/2016 Lehrling

* cited by examiner

COMPLETION ISOLATION SYSTEM WITH TUBING MOVEMENT COMPENSATOR

CROSS-REFERECE TO RELATED APPLICATION

The present document is the National Stage Entry of International Application No. PCT/US2021/039873, filed Jun. 30, 2021, which is based on and claims priority to U.S. Provisional Patent Application Ser. No. 63/047,401, filed Jul. 2, 2020, which is incorporated herein by reference in its entirety.

BACKGROUND

Open hole completions are widely used with various techniques including open hole gravel packing, standalone screens, slotted liners, perforated pipes, or expandable screens. Cased hole completions are also widely used. For reservoir management, isolation packers may be included in completion systems to isolate two or more zones of the wellbore. An effective isolation between zones requires a mechanical bond between the element and the tubular and a bond between the borehole surface and the element. However, movement of the tubular due to temperature or pressure changes downhole may compromise the bond between the borehole surface and the element, and may even cause the element to damage the borehole surface.

SUMMARY

A system according to one or more embodiments of the present disclosure includes a tubular disposed within a borehole, a sleeve disposed around the tubular, and an isolation element bonded to an outer diameter of the sleeve. In one or more embodiments of the present disclosure, an inner diameter of the sleeve is connected to an outer diameter of the tubular via a plurality of seals. In one or more embodiments of the present disclosure, the isolation element is configured to conform to a surface of the borehole when the isolation element is in an expanded configuration. According to one or more embodiments of the present disclosure, the sleeve compensates for movement of the tubular by being able to freely move across the tubular.

A method according to one or more embodiments of the present disclosure includes deploying a completion system into a wellbore, the completion system including: a tubular, a sleeve disposed around the tubular, and an isolation element bonded to an outer diameter of the sleeve. In one or more embodiments of the present disclosure, an inner diameter of the sleeve is connected to an outer diameter of the tubular via a plurality of seals. In one or more embodiments of the present disclosure, the isolation element is in an unexpanded configuration during the deploying step. The method according to one or more embodiments of the present disclosure also includes actuating the isolation element such that the isolation element conforms to a surface of the borehole in an expanded configuration, and maintaining an integrity of a first bond between the isolation element and the outer diameter of the sleeve, and a second bond between the isolation element in the expanded configuration and the surface of the borehole by allowing the sleeve to freely move across the tubular.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "up" and "down," "upper" and "lower," "upwardly" and "downwardly," "upstream" and "downstream," "uphole" and "downhole," "above" and "below," "top" and "bottom," "left" and "right," and other like terms indicating relative positions above or below a given point or element are used in this description to more clearly describe some embodiments of the disclosure.

The present disclosure generally relates to completion isolation applications. More specifically, one or more embodiments of the present disclosure relates to a completion isolation system that includes an isolation element bonded to a movable sleeve that is connected to a tubular for completion isolation applications, which may include, for example, isolating a non-producing zone, controlling the production or injection from each zone, or isolating a zone producing an unwanted fluid (e.g., water or gas for an oil producing well). Advantageously, allowing free movement of the sleeve compensates for undesirable movement of the tubular, due to temperature and pressure fluctuations, for example. Due to this configuration according to one or more embodiments of the present disclosure, the integrity of the seals between the borehole surface and the isolation element (in open hole applications) or between the casing surface and the isolation element (in cased hole applications), and between the tubular and the isolation element via the sleeve, are not compromised, thereby improving the effectiveness of isolation between zones within the completion system.

Figure 1:
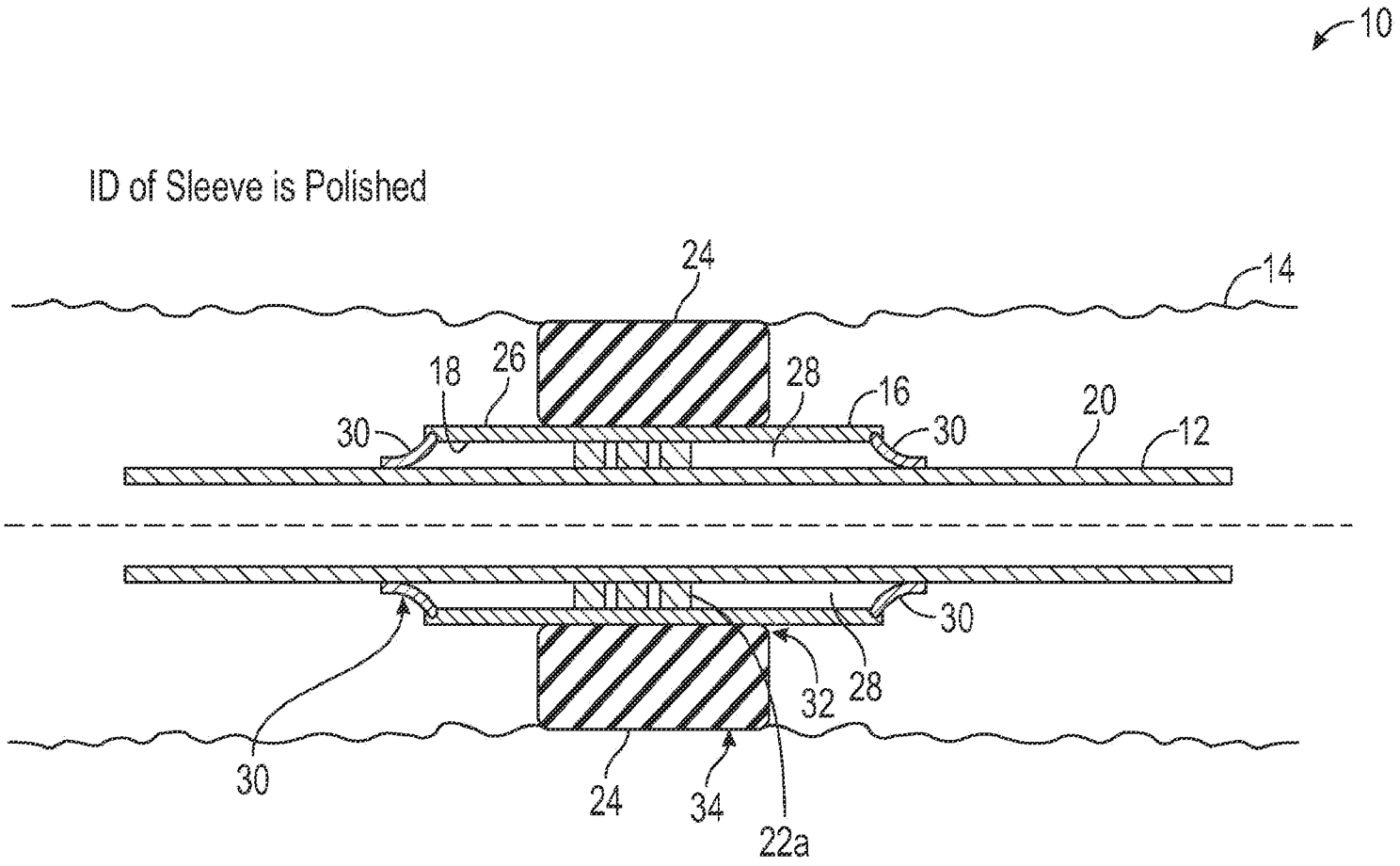
FIG. 1 shows a completion isolation system, according to one or more embodiments of the present disclosure.

Referring now to FIG. 1, a completion isolation system according to one or more embodiments of the present disclosure is shown. As shown in FIG. 1, the system 10 may include a tubular 12 disposed within a bore hole 14, and a sleeve 16 disposed around the tubular 12. According to one or more embodiments of the present disclosure, the tubular 12 and the sleeve 16 may be arranged so as to create annular spaces 28 between an outer diameter 20 of the tubular 12 and an inner diameter 18 of the sleeve 16. Further, in one or more embodiments of the present disclosure, the inner diameter 18 of the sleeve 16 may be connected to the outer diameter 20 of the tubular 12 via a plurality of seals 22*a*. As shown in FIG. 1, for example, the plurality of seals 22*a* may include a series of bonded seals (or o-rings) fixed to the outer diameter 20 of the tubular 12 and disposed in the annular spaces 28 between the outer diameter 20 of the tubular 12 and the inner diameter 18 of the sleeve 16. While three bonded seals 22*a* are shown disposed in the annular spaces 28 of FIG. 1, the amount of bonded seals in the plurality of seals 22*a* is not limiting, and any amount of bonded seals is contemplated and within the scope of the present disclosure.

As further shown in FIG. 1, the system 10 may also include an isolation element 24 bonded to an outer diameter 26 of the sleeve 16, according to one or more embodiments of the present disclosure. The isolation element 24 according to one or more embodiments of the present disclosure may include at least one of an elastomeric element, a swellable element, a mechanical packer, and a hydraulically set packer, for example. The isolation element 24, as a component of the completion system 10 according to one or more embodiments of the present disclosure, may assume an unexpanded configuration as the system 10 is deployed into a wellbore. In one or more embodiments of the present disclosure, end rings with corresponding shear pins (not shown) may be added to the ends of the sleeve 16 to prevent the sleeve 16 from moving during deployment. Once the shear pins are sheared by achieving the requisite tension on the sleeve 16, free movement of the sleeve 16, as further described below, may be achieved. After deployment, and once the system 10 reaches a desired location within the wellbore, the isolation element 24 may be actuated into an expanded configuration such that the isolation element 24 conforms to a surface of the bore hole 14. Therefore, the completion system 10 according to one or more embodiments of the present disclosure includes a first bond 32 between the isolation element 24 and the outer diameter 26 of the sleeve 16, and a second bond 34 between the isolation element 24 in the expanded configuration and the surface of the bore hole 14.

In one or more embodiments of the present disclosure, actuation of the isolation element 24 from the unexpanded configuration to the expanded configuration may occur hydraulically, electrically, remotely, wirelessly, mechanically, chemically, via pressure, or magnetically, for example. Once the isolation element 24 is in the expanded configuration, completion isolation applications, such as controlling the production or injection from a given zone, isolating a non-producing zone, or isolating a zone that is producing an unwanted fluid (e.g., water or gas for an oil producing well), for example, may proceed in the wellbore.

During completion isolation operations, and otherwise while the completion system 10 is disposed in the wellbore, the tubular 12 may be exposed to temperature and/or pressure fluctuations that may cause the tubular 12 to undesirably move. Advantageously, in the system 10 according to one or more embodiments of the present disclosure, the sleeve 16 compensates for this movement of the tubular 12 by being able to freely move across the tubular 12. In this way, the sleeve 16 is able to maintain the integrity of the first bond 32 between the isolation element 24 and the outer diameter 26 of the sleeve 16, and the second bond 34 between the isolation element 24 in the expanded configuration and the surface of the bore hole 14 by allowing the sleeve 16 to freely move across the tubular 12. As shown in FIG. 1, for example, the inner diameter 18 of the sleeve 16 may be polished, which facilitates free movement of the sleeve 16 across the tubular 12, according to one or more embodiments of the present disclosure.

As further shown in FIG. 1, the system 10 may include at least one debris seal 30 attached to an end of the sleeve 16 and the outer diameter 20 of the tubular 12. In one or more embodiments of the present disclosure, placement of the at least one debris seal 30 in this way minimizes debris from entering the annular spaces 28 between the outer diameter 20 of the tubular 12 and the inner diameter 18 of the sleeve 16.

Figure 2:
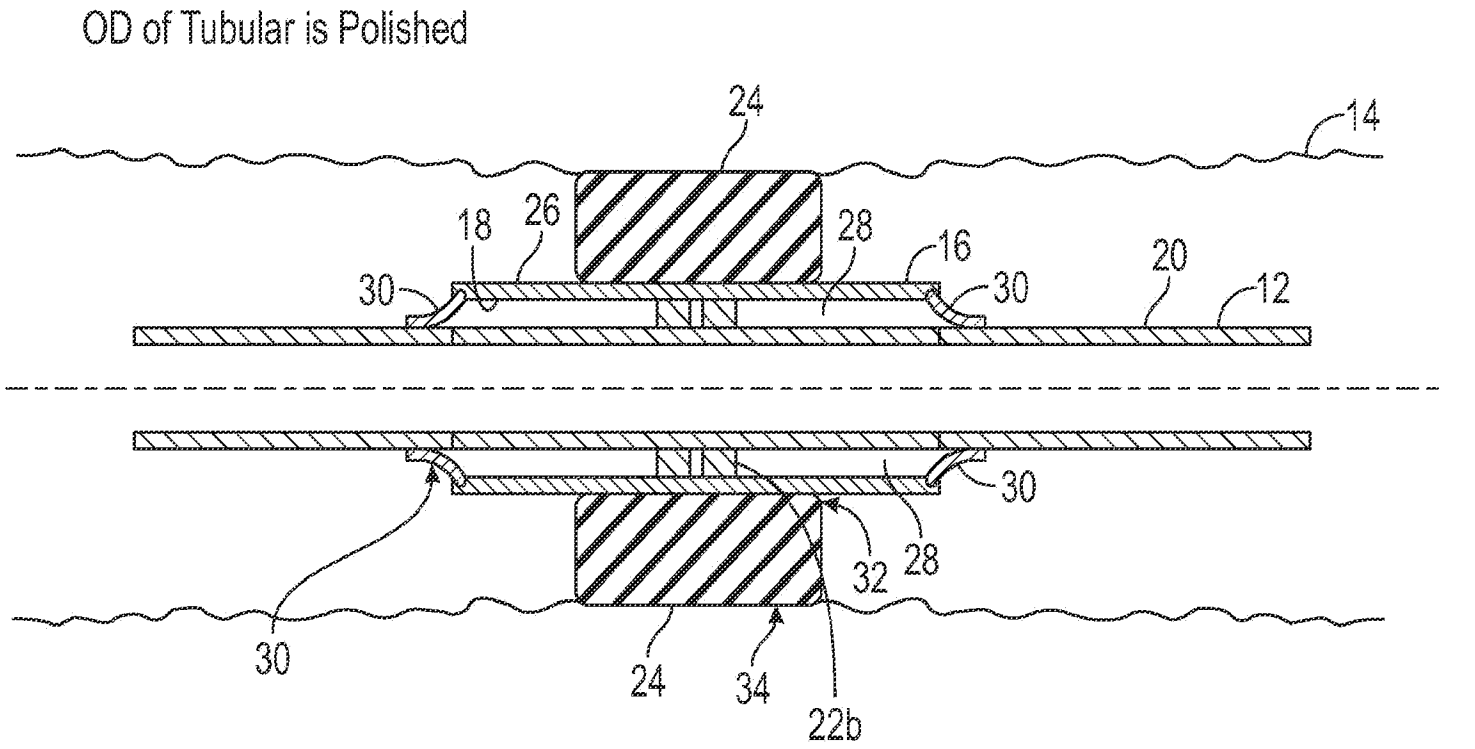
FIG. 2 shows another completion isolation system, according to one or more embodiments of the present disclosure.

Referring now to FIG. 2, another completion isolation system according to one or more embodiments of the present disclosure is shown. Only the key differences between FIG. 2 and FIG. 1, as previously described, will be provided here. Like elements between FIG. 2 and FIG. 1 are associated with the same reference numeral to facilitate clarity. As shown in FIG. 2, in one or more embodiments of the present disclosure, the inner diameter 18 of the sleeve 16 may be connected to the outer diameter 20 of the tubular 12 via a plurality of seals 22*b*. As shown in FIG. 2, for example, the plurality of seals 22*b* may include a series of bonded seals (or o-rings) fixed to the inner diameter 18 of the sleeve 16 and disposed in the annular spaces 28 between the outer diameter 20 of the tubular 12 and the inner diameter 18 of the sleeve 16. While two bonded seals 22*b* are shown disposed in the annular spaces 28 of FIG. 2, the amount of bonded seals in the plurality of seals 22*b* is not limiting, and any amount of bonded seals is contemplated and within the scope of the present disclosure.

Similar to the completion system 10 described with respect to FIG. 1, the sleeve 16 of the system 10 of FIG. 2 compensates for undesirable movement of the tubular 12 by being able to move across the tubular 12. As shown in FIG. 2, in one or more embodiments of the present disclosure, at least a portion of the outer diameter 20 of the tubular 12 may be polished, which facilitates free movement of the sleeve 16 across the tubular 12. Specifically, in one or more embodiments of the present disclosure, the portion of the outer diameter 20 of the tubular 12 that coincides with the annular space 28 may be polished, as shown in FIG. 2, for example.

While the aforementioned embodiments of the present disclosure in view of FIGS. 1 and 2 may describe an open hole completion isolation system, one or more embodiments of the present disclosure may also be applicable to cased hole completion isolation systems, where the aforementioned borehole surface is a surface of a casing or other metallic tubular, without departing from the scope of the present disclosure.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

a tubular disposed within a borehole;

a sleeve disposed around the tubular, an inner diameter of the sleeve being connected to an outer diameter of the tubular via a plurality of seals; and an isolation element bonded to an outer diameter of the sleeve, the isolation element configured to conform to a surface of the borehole when the isolation element is in an expanded configuration, wherein the tubular is configured to freely move substantially a distance equal to the entirety of the length of the sleeve, when the isolation element is in its expanded configuration.

2. The system of claim 1, wherein the plurality of seals comprises a series of bonded seals fixed to the outer diameter of the tubular and disposed in annular spaces between the outer diameter of the tubular and the inner diameter of the sleeve.

3. The system of claim 2, wherein the inner diameter of the sleeve is polished, which facilitates free movement of the sleeve across the tubular.

4. The system of claim 3, wherein the plurality of seals further comprises at least one debris seal attached to an end of the sleeve and the outer diameter of the tubular, which minimizes debris from entering the annular spaces between the outer diameter of the tubular and the inner diameter of the sleeve.

5. The system of claim 2, wherein the plurality of seals further comprises at least one debris seal attached to an end of the sleeve and the outer diameter of the tubular, which minimizes debris from entering the annular spaces between the outer diameter of the tubular and the inner diameter of the sleeve.

6. The system of claim 1, wherein the plurality of seals comprises a series of bonded seals fixed to the inner diameter of the sleeve and disposed in annular spaces between the outer diameter of the tubular and the inner diameter of the sleeve.

7. The system of claim 6, wherein at least a portion of the outer diameter of the tubular is polished, which facilitates free movement of the sleeve across the tubular.

8. The system of claim 7, wherein the plurality of seals further comprises at least one debris seal attached to an end of the sleeve and the outer diameter of the tubular, which minimizes debris from entering the annular spaces between the outer diameter of the tubular and the inner diameter of the sleeve.

9. The system of claim 6, wherein the plurality of seals further comprises at least one debris seal attached to an end of the sleeve and the outer diameter of the tubular, which minimizes debris from entering the annular spaces between the outer diameter of the tubular and the inner diameter of the sleeve.

10. The system of claim 1, wherein the isolation element comprises at least one selected from the group consisting of: an elastomeric element; a swellable element; a mechanical packer; and a hydraulically set packer.

11. A method, comprising:

deploying a completion system into a wellbore, the completion system comprising:

a tubular;

a sleeve disposed around the tubular, an inner diameter of the sleeve being connected to an outer diameter of the tubular via a plurality of seals; and an isolation element bonded to an outer diameter of the sleeve, wherein, during deploying, the isolation element is in an unexpanded configuration;

actuating the isolation element such that the isolation element conforms to a surface of the wellbore in an expanded configuration; and maintaining an integrity of a first bond between the isolation element and the outer diameter of the sleeve, and a second bond between the isolation element in the expanded configuration and the surface of the wellbore by allowing the tubular to move within the sleeve substantially a distance equal to the entirety of the length of the sleeve.

12. The method of claim 11, further comprising: performing a completion isolation application after actuating the isolation element.

13. The method of claim 11, wherein the plurality of seals comprises a series of bonded seals fixed to the outer diameter of the tubular and disposed in annular spaces between the outer diameter of the tubular and the inner diameter of the sleeve.

14. The method of claim 13, wherein the inner diameter of the sleeve is polished, which facilitates free movement of the sleeve across the tubular.

15. The method of claim 14, further comprising: minimizing debris from entering the annular spaces between the outer diameter of the tubular and the inner diameter of the sleeve.

16. The method of claim 13, further comprising: minimizing debris from entering the annular spaces between the outer diameter of the tubular and the inner diameter of the sleeve.

17. The method of claim 11, wherein the plurality of seals comprises a series of bonded seals fixed to the inner diameter of the sleeve and disposed in annular spaces between the outer diameter of the tubular and the inner diameter of the sleeve.

18. The method of claim 17, wherein at least a portion of the outer diameter of the tubular is polished, which facilitates free movement of the sleeve across the tubular.

19. The method of claim 18, further comprising: minimizing debris from entering the annular spaces between the outer diameter of the tubular and the inner diameter of the sleeve.

20. The method of claim 17, further comprising: minimizing debris from entering the annular spaces between the outer diameter of the tubular and the inner diameter of the sleeve.

21. A system, comprising:

a tubular disposed within a borehole;

a sleeve disposed around the tubular, an inner diameter of the sleeve being connected to an outer diameter of the tubular via a plurality of seals; and an isolation element between the sleeve and a surface of the borehole and configured to conform to the surface of the borehole when the isolation element is in an expanded configuration, wherein the tubular is configured to freely move within the sleeve substantially a distance equal to the entirety of the length of the sleeve.

* * * * *